US008084983B2

(12) United States Patent
Lee

(10) Patent No.: US 8,084,983 B2
(45) Date of Patent: Dec. 27, 2011

(54) LAUNDRY TREATMENT MACHINE AND METHOD OF CONTROLLING THE SAME

(75) Inventor: Un Yong Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 511 days.

(21) Appl. No.: 12/230,704

(22) Filed: Sep. 3, 2008

(65) Prior Publication Data

US 2009/0066284 A1 Mar. 12, 2009

(30) Foreign Application Priority Data

Sep. 4, 2007 (KR) ..... 10-2007-0089505

(51) Int. Cl.
*G05D 23/00* (2006.01)

(52) U.S. Cl. ..... 318/641; 318/400.01; 318/400.06; 318/400.22

(58) Field of Classification Search ..... 318/400.01, 318/400.22, 471, 641, 280, 400.06, 634, 318/560, 432, 700, 779, 799
See application file for complete search history.

(56) References Cited

U.S. PATENT DOCUMENTS

| | | | | |
|---|---|---|---|---|
| 5,038,586 | A * | 8/1991 | Nukaga et al. | 68/12.01 |
| 6,949,945 | B2 * | 9/2005 | Klein | 374/185 |
| 6,992,452 | B1 * | 1/2006 | Sachs et al. | 318/434 |
| 7,221,121 | B2 * | 5/2007 | Skaug et al. | 318/807 |
| 7,446,494 | B2 * | 11/2008 | Grabinger et al. | 318/471 |
| 7,612,513 | B2 * | 11/2009 | Ando et al. | 318/434 |

FOREIGN PATENT DOCUMENTS

| | | |
|---|---|---|
| KR | 10-2000-0031202 | 6/2000 |
| KR | 10-2006-0086010 | 7/2006 |

* cited by examiner

*Primary Examiner* — Walter Benson
*Assistant Examiner* — Antony M Paul
(74) *Attorney, Agent, or Firm* — McKenna Long & Aldridge LLP

(57) ABSTRACT

There are provided a laundry treatment machine and a method of controlling the same. A temperature around a motor is sensed and the range of current input to the motor in accordance with the sensed temperature is limited in stages. Therefore, the surrounding of the motor can be prevented from being overheated. In addition, since the range of the current input to the motor is limited in stages, when the current applied to the motor is limited, abnormal noise is not generated and the torque of the motor can be maximized.

4 Claims, 4 Drawing Sheets

FIG. 4

| T range | Current Limitation |
|---|---|
| $T1 \leq T \leq T2$ | Imax |
| $T2 < T \leq T3$ | Imed |
| $T3 < T \leq T4$ | Imin |

LAUNDRY TREATMENT MACHINE AND METHOD OF CONTROLLING THE SAME

This application claims the benefit of Korean Patent Application No. 10-2007-0089505 filed on Sep. 4, 2007 which is hereby incorporated by reference for all purposes as if fully set forth herein.

BACKGROUND OF THE INVENTION

1. Field of the Invention

The present invention relates to a laundry treatment machine and a method of controlling the same, and more particularly, to a laundry treatment machine and a method of controlling the same capable of controlling current input to the motor in accordance with the temperature around a motor to prevent the surrounding of the motor from being overheated and to maximize the torque of the motor.

2. Discussion of the Related Art

In general, a laundry treatment machine is divided into a washing machine for detaching contaminants attached to the laundry such as clothes and bedclothes using water, detergent, and a mechanical operation, a drier for drying the wet laundry using dry and hot wind heated by a heater and a mechanical operation, and a dry washing machine for both washing and drying.

In conventional washing machines, a drum washing machine includes a motor for rotating a drum and an intelligent power module (IMP) unit for driving the motor.

Since the IPM unit emits heat when the motor is driven, the current input to the motor is previously limited so that the heat is not excessively emitted by the IPM unit. That is, the current input to the motor is previously set not to exceed a predetermined value so that the IMP unit is previously prevented from being overheated.

However, since the current is previously limited regardless of the temperature of the IPM unit in a conventional art, when the current is forcibly limited in a state where the temperature of the IPM unit is not high, the torque of the motor deteriorates and abnormal noise is generated.

SUMMARY OF THE INVENTION

In order to solve the above-described problems, it is an object of the present invention to provide a laundry treatment machine and a method of controlling the same capable of preventing a motor from being overheated and of improving the torque of the motor.

In order to achieve the above object, a laundry treatment machine includes a motor for rotating a drum to which laundry is input, and a controller for supplying current to the motor to drive the motor and for limiting a range of current input to the motor in accordance with a temperature around the motor.

The laundry treatment machine further includes a temperature sensor for sensing the temperature around the motor.

The controller limits the range of the current input to the motor in accordance with increase in the temperature value sensed by the temperature sensor in stages.

In a method of controlling a laundry treatment machine, current is supplied to a motor to drive the motor in order to rotate a drum to which laundry is input and a range of the current input to the motor is limited in accordance with a temperature around the motor.

The range of the current input to the motor is limited in accordance with increase in the temperature around the motor in stages.

The method further includes sensing a temperature around the motor, setting a range of current input to the motor in accordance with a temperature value sensed in sensing a temperature around the motor, and supplying the current in the range set in setting the range of the current to the motor.

Setting the range of current includes calculating the range of the current corresponding to a temperature range to which the sensed temperature value belongs and setting the range calculated in calculating the range of the current to the range of the current.

The range of the current in accordance with the temperature around the motor is previously set in a table and, in calculating the range of the current, the range of the current is calculated from the table.

The table is previously set in consideration of the performance of the motor, the load of the motor, and the characteristic of the current.

In sensing the temperature, a temperature of an intelligent power module (IPM) unit of the motor is sensed.

In a laundry treatment machine according to the present invention and a method of controlling the same, a temperature around a motor is sensed and the range of current input to the motor in accordance with the sensed temperature is limited in stages. Therefore, since the range of the current that can maximize the torque of the motor is selected, the torque of the motor can be maximized. In addition, the surrounding of the motor can be prevented from being overheated.

BRIEF DESCRIPTION OF THE DRAWINGS

FIG. 4 is a plurality of current limitation values and temperature ranges which are stored in the memory in a tabular form.

DETAILED DESCRIPTION OF THE PREFERRED EMBODIMENTS

Hereinafter, a drum washing machine as an embodiment of a laundry treatment machine according to the present invention will be described with reference to the drawings.

Figure 1:
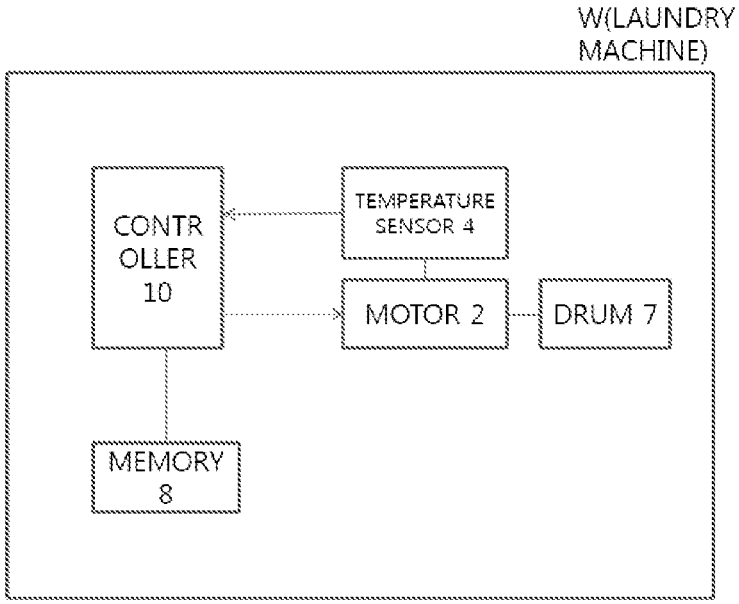
FIG. 1 is a block diagram illustrating the structure of a drum washing machine according to an embodiment of the present invention.

FIG. 1 is a block diagram illustrating the structure of a drum washing machine according to an embodiment of the present invention.

Referring to FIG. 1, the drum washing machine W includes a motor 2 for rotating a drum 7 to which the laundry is input, a temperature sensor 4 for sensing the temperature around the motor 2, a controller 10 for controlling the motor 2 in accordance with the temperature value sensed by the temperature sensor 4 and memory 8 for storing a plurality of current limitation values and a plurality of temperature ranges.

The drum washing machine W further includes a cabinet 5 for forming an external appearance and a tub 6 provided in the cabinet 5. The drum 7 is rotatably provided in the tub 6.

The motor 2 includes an intelligent power module (IPM) unit for driving the motor 2.

The temperature sensor 4 senses the temperature of the IPM unit. The temperature sensor can be additionally mounted in the motor 2 and can be included in the IPM unit.

The controller 10 receives a temperature value from the temperature sensor 4 and limits the range of the current input to the motor 2 in accordance with the temperature value in stages.

The method of controlling the drum washing machine having the above structure will be described as follows.

Figure 2:
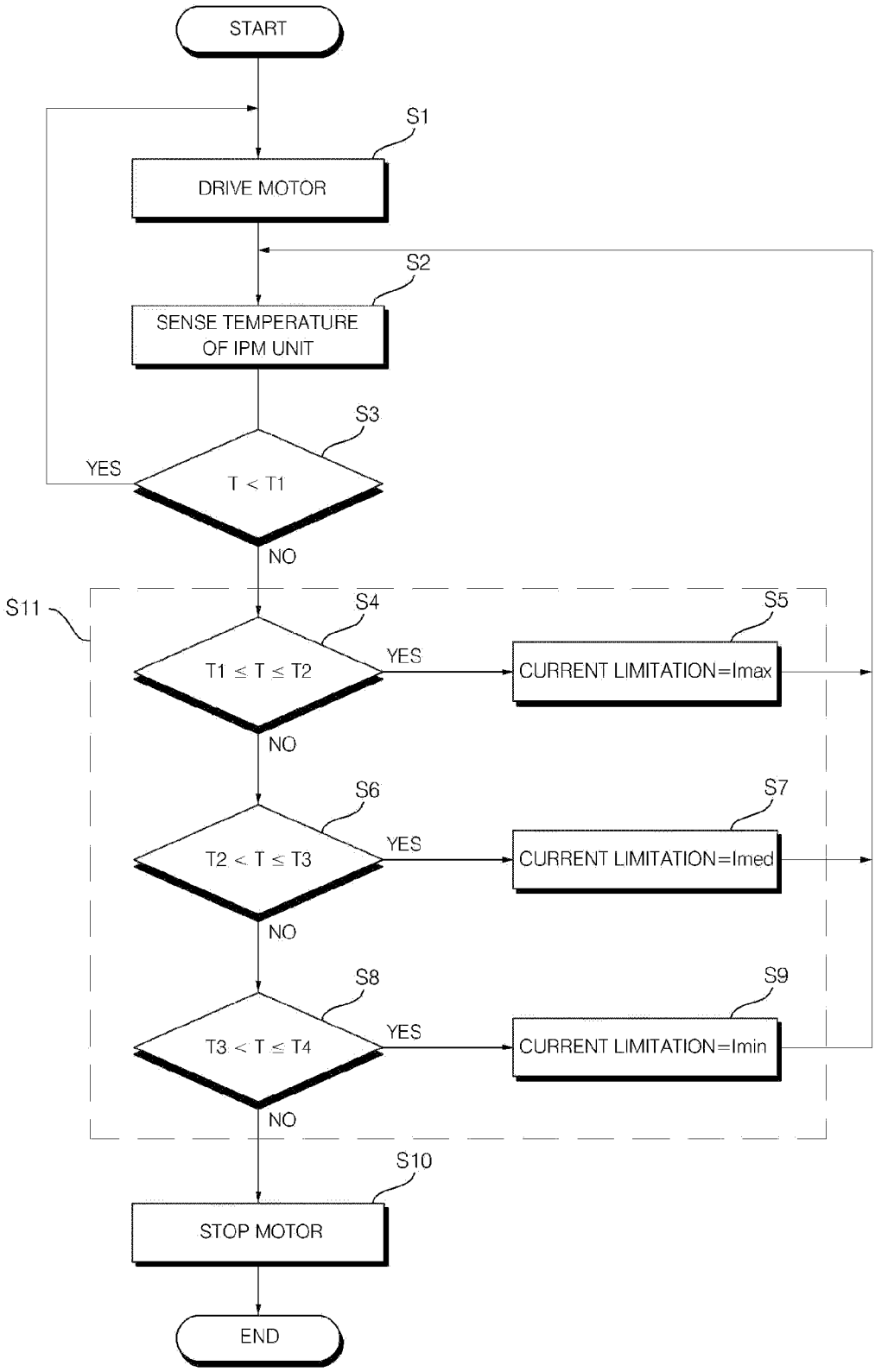
FIG. 2 is a flowchart illustrating a method of controlling the drum washing machine according to the embodiment of the present invention.
Figure 3:
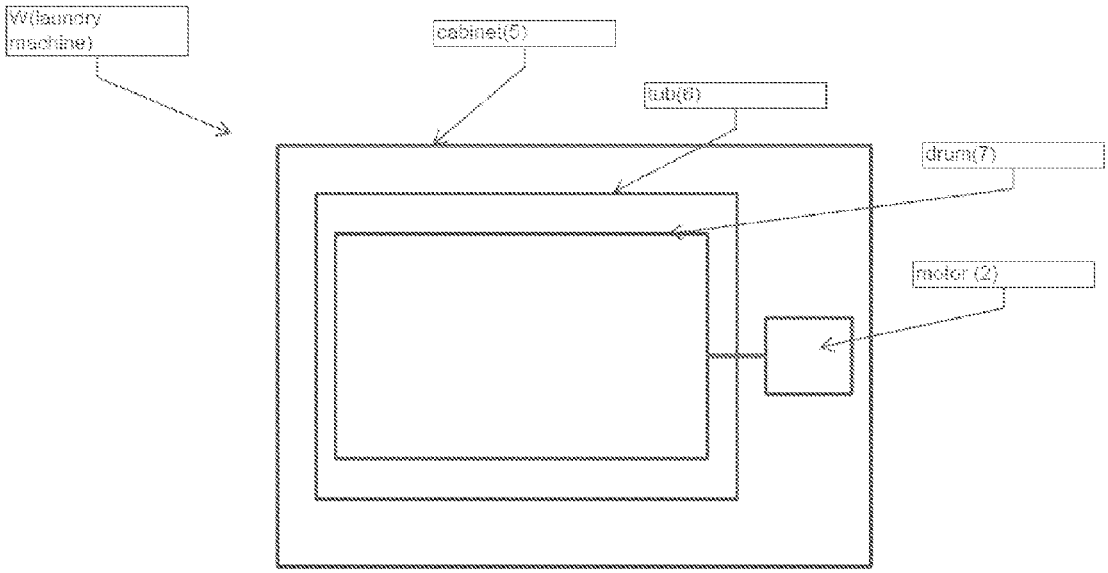
FIG. 3 is a drum washing machine according to an embodiment of the present invention.

FIG. 2 is a flowchart illustrating a method of controlling the drum washing machine according to the embodiment of the present invention. And FIG. 4 is a plurality of current limitation values and temperature ranges which are stored in the memory in a tabular form.

Referring to FIG. 2 and 4, when the washing machine starts to be driven, the current is supplied to the motor 2 so that the motor 2 is driven (S1).

When the motor 2 is driven, the controller 10 senses the temperature around the motor 2 (S2). In the temperature sensing step, the temperature sensor senses the temperature of the IPM unit of the motor 2.

Then, the controller 10 sets the range of the current (S10). In the current range setting step, the range of the current input to the motor 2 is set in accordance with the temperature value sensed in the temperature sensing step.

In the current range setting step (S10), the range of the current corresponding to the range of the temperature to which the temperature value belongs is calculated. Then, the range of the current calculated in the current range calculating step is set to the range of the current input to the motor 2.

In the controller 10, the range of the current in accordance with the temperature value is previously set in a table. Therefore, when the temperature is sensed, the range of the current can be calculated from the table. The table can be set in consideration of the performance of the motor, the load of the motor, and the characteristic of the current as well as the temperature value.

When the temperature value sensed in the temperature sensing step is smaller than a first reference temperature T1 (S3), the controller 10 continuously and normally drives the motor 2.

On the other hand, when the temperature value is no less than the first reference temperature T1 and no more than a second reference temperature T2 (S4), in the current range calculating step, the range of the current is calculated to be no more than a first current limit value Imax (S5). Therefore, the current input to the motor 2 is limited not to exceed the first current limit value Imax.

Then, the temperature sensing step and the current range setting step are continuously and repeatedly performed.

On the other hand, when the temperature value is larger than the second reference temperature T2 and no more than a third reference temperature T3 (S6), in the current range calculating step, the range of the current is calculated to no more than a second current limit value Imed (S7). Here, the second current limit value Imed is smaller than the second current limit value Imax. Therefore, the current input to the motor 2 is limited not to exceed the second current limit value Imed. That is, since the temperature of the IPM unit rose, the limit value of the current input to the motor 2 is reduced.

Then, the temperature sensing step and the current range setting step are continuously and repeatedly performed.

On the other hand, when the temperature value is larger than the third reference temperature T3 and no more than a fourth reference temperature T4 (S8), in the current range calculating step, the range of the current is calculated to no more than a third current limit value Imin (S9). Here, the third current limit value Imin is smaller than the second current limit value Imed. Therefore, the current input to the motor 2 is limited not to exceed the third current limit value Imin.

That is, as the temperature of the IPM unit rises, the limit value of the current input to the motor 2 is reduced so that the IPM unit is prevented from being overheated in accordance with the temperature of the IPM unit.

Then, the temperature sensing step and the current range setting step are continuously and repeatedly performed.

On the other hand, when the temperature is larger than the fourth reference temperature T4, the controller 10 determines that control is not normally performed to stop the driving of the motor 2 (S10).

What is claimed is:

1. A laundry machine comprising:

a drum;

a motor for rotating the drum;

a temperature sensor positioned such that it is capable of sensing temperature sufficiently close to the motor;

a memory storing a plurality of temperature ranges, wherein each of the plurality of temperature ranges is associated with a corresponding one of a plurality of current limitation values; and a controller configured to supply a driving current to the motor, wherein the controller compares the sensed temperature to one or more of the plurality of temperature ranges and selects one of the plurality of current limitation values based on the comparison between the sensed temperature and the one or more temperature ranges, and the selected current limitation value serves as a limit for the driving current.

2. A method of controlling a laundry machine comprising a drum and a motor which rotates the drum, said method comprising:

supplying a driving current to the motor;

sensing a temperature sufficiently close to the motor;

controlling the driving current as a function of the temperature;

storing a plurality of current limitation values;

storing a plurality of temperature ranges, wherein each of the plurality of temperature ranges is associated with a corresponding one of the plurality of current limitation values;

comparing the temperature to one or more of the plurality of temperature ranges; and selecting one of the plurality of current limitation values based on the comparison between the temperature and the one or more temperature ranges, wherein the selected current limitation value serves as a limit for the driving current.

3. The method of claim 2, wherein storing the plurality of current limitation values and storing the plurality of temperature ranges comprises:

storing the plurality of current limitation values and the plurality of temperature ranges in a memory in tabular form.

4. The method of claim 2, wherein the plurality of current limitation values and the plurality of temperature ranges are based on motor performance, the load on the motor and current.

* * * * *